United States Patent [19]

Ignell

[11] 4,149,651

[45] Apr. 17, 1979

[54] CLOSURE DEVICE

[75] Inventor: Rolf L. Ignell, Lund, Sweden

[73] Assignee: Tetra Pak Developpement SA, Lausanne, Switzerland

[21] Appl. No.: 649,229

[22] Filed: Jan. 15, 1976

Related U.S. Application Data

[63] Continuation of Ser. No. 460,159, Apr. 11, 1974, abandoned.

[30] Foreign Application Priority Data

Apr. 19, 1973 [SE] Sweden ..... 7305612

[51] Int. Cl.[2] ..... B65D 41/02

[52] U.S. Cl. ..... 220/265; 215/354; 215/355; 220/266

[58] Field of Search ..... 220/265, 266, 267, 269; 215/354, 355

[56] References Cited

U.S. PATENT DOCUMENTS

| | | | |
|---|---|---|---|
| 3,083,858 | 4/1963 | Biedenstein | 220/265 |
| 3,251,499 | 5/1966 | Rausing | 215/355 |
| 3,348,719 | 10/1967 | Rausing | 215/354 |
| 3,415,405 | 12/1968 | Rausing | 215/354 |
| 3,608,771 | 9/1971 | Monroe | 220/266 |

FOREIGN PATENT DOCUMENTS

| | | | |
|---|---|---|---|
| 218322 | 8/1964 | Sweden | 220/265 |
| 224890 | 3/1966 | Sweden | 220/265 |

*Primary Examiner*—Ro E. Hart

*Attorney, Agent, or Firm*—Burns, Doane, Swecker & Mathis

[57] ABSTRACT

The functioning of the cap part of a closure device having a thin-walled packing container is improved by applying a non-perforating score to the cap part in a position perpendicular to the direction of pull of the pull ring of the cap part.

2 Claims, 2 Drawing Figures

CLOSURE DEVICE

Figure 1:
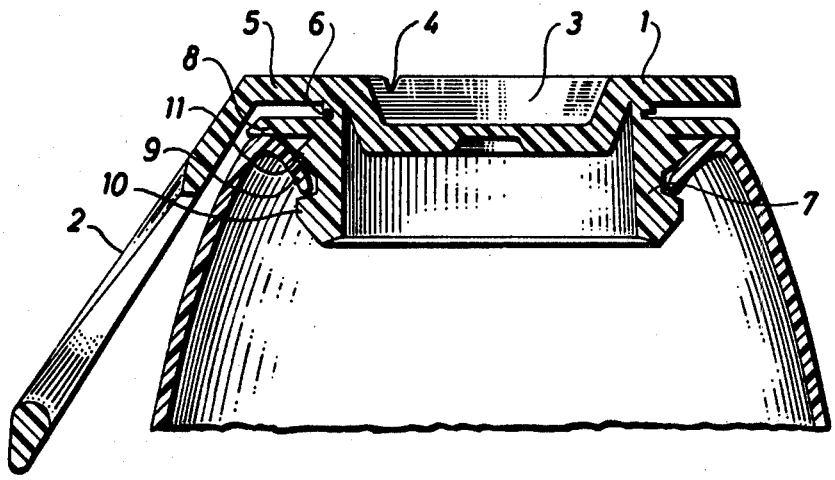

This is a continuation of application Ser. No. 460,159 filed Apr. 11, 1974, now abandoned.

The present invention relates to a closure device for a thin-walled packing container comprising a cap part, a pull ring and a tubular part which is provided with a sealing ring and a retaining flange, the said tubular part being fitted into an emptying opening of the package in such a manner that it joins tightly to an inwards turned lip formed of the package wall.

In the use of packages manufactured of a thin, flexible material and intended for liquid contents, especially contents under pressure such as beer and carbonated beverages, there has been a need for a long time of a closure device which, on the one hand, is apt to fit tightly against the thin flexible wall material in the packing container, whilst on the other hand, it can readily be opened so as to allow the emptying of the contents from the packing container.

The closure devices which are on the market for packing containers made of a thin, flexible plastic material comprise substantially a cap part, a pull ring joined to the cap part, and a tubular profiled part. The closure devices are manufactured mainly by injection moulding, the cap part being joined to the tubular profiled part by means of a narrow area of material.

The closure device is fitted into the emptying opening of the package after the package has been filled with its contents. During closing, the inwards turned lip formed of the package wall is made to fit tightly against the tubular part of the closure device. The closure device is retained in the emptying aperture by a part of the lip turned inwards being applied in a region between two flanges projecting from the tubular part.

For the uncovering of the emptying aperture with the object of allowing the contents to be discharged, the ring-shaped pulling part lying against the package wall is bent up to a position which is substantially perpendicular to the top of the cap part, whereupon a force is applied to the said pulling part. When this force has reached sufficient magnitude, the cap part of the closure device will be detached from the tubular part of the closure device, in that the narrow portion which connects the cap part to the tubular part is torn open.

When these earlier known closure devices were used, a relatively great force was required to separate the said cap part from the tubular part, since a great part of the force is used on the one hand to bend up the cap part of the closure device, on the other hand to charge a relatively large part of the sealing area during the initial phase. To overcome the said disadvantages certain closure devices have been provided with a perforation in the outer edge of the cap part. The said perforation extends from the region of attachment of the ring-shaped pull part in the outer edge of the cap part, towards that portion of the cap part which covers the emptying aperture. It was found, however, that the said perforation does not serve the intended purpose. Moreover it was found, when the said closure device with perforation was used, that the pull ring and a part of the cap part, in case of incorrect handling, are easily torn off the closure device. Such an occurrence creates a good deal of inconvenience, since some kind of tool or pointed object has to be used then to uncover the emptying aperture of the packing container.

Another problem with the said closure device consists in that a part of the contents tends to squirt out through the opening appearing in the initial stage of the opening action in the part of the material which joins together the cap part and the tubular part. This is due to the gas enclosed in the package receiving excessively high velocity owing to the opening formed in the initial stage being excessively small.

These inconveniences are overcome by the present invention which is based on the principle that a hinge in the form of a non-perforating score is formed in the cap part of the closure device with the object that it should in the initial stage of the opening action constitute the pivot for a "lever arm", which is formed of the pull ring and of the material in the cap part which is in the region between the said score and the pull ring.

The invention is characterized in that a score is applied to the cap part of the closure device, which is perpendicular to the direction of pull, and which is applied in such a position that the tear ring is situated between the score and the pull ring.

Figure 2:
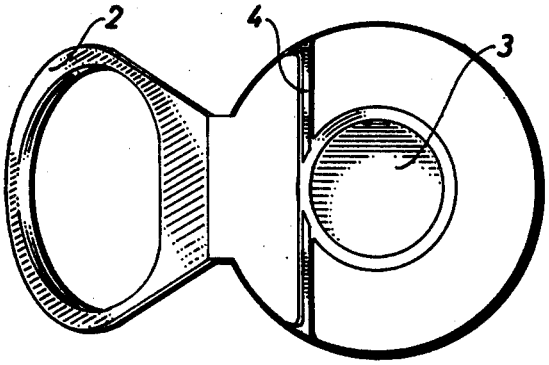

The invention will be described in the following with reference to the enclosed schematic drawing, in which FIG. 1 shows the closure device fitted into an emptying opening, and FIG. 2 shows the cap part and pull ring of the closure device.

The closure device comprises a cap part 1, a pull ring 2 and a tubular part 7. The cap part 1 consists of a recessed area 3, a score 4 and a flange 5 surrounding the recessed area 3 of the cap part. The tubular part 7 comprises an upper flange 8, a sealing ring 11, a retaining flange 10 and a tear ring 6 situated between the cap part 1 and the tubular part 7.

For the closing of the package filled with its contents, the closure device is fitted into the emptying opening of the container, in that the lip 9 formed by the package wall is made to "snap" in between the sealing ring 11 and the retaining flange 10. The flange 10 projecting from the tubular part of the closure device will then prevent the closure device from detaching itself from the package. During the closing action and during the time until the uncovering of the emptying opening, the cap part 1 of the closure device is joined to the tubular part 7 by means of a tear ring 6. When the emptying opening is uncovered, this tear ring 6 will be torn up. By the formation of a non-penetrating score 4 in the upper side of the cap part in such a position that the tear ring 6 will be situated in the region between the score 4 and the pull ring, the region between the pull ring and the score will constitute a "lever arm" with the score as a pivot 4, the tear ring being on the said lever arm at a relatively short distance from the pivot 4. Since the distance between the pull ring and the score is greater than the distance between the tear ring and the score, it will be possible to tear up the tear ring with ease when the pull ring is bent up to a position of approx. 90° to the upper side of the cap. After the said sealing region has been broken up, it is easy by continued pulling of the pull ring 2 to continue the breaking open of the sealing region.

By virtue of the score acting as a hinge, less force is needed for folding up the cap part 1 of the closure device, which further increases the energy-saving effect of the invention.

When the closure device described is used, a greater area of the sealing region will be torn open in the initial stage, so that the outflowing gas will receive a lower velocity thus preventing any liquid from being entrained by the outflowing gas.

As less force is needed for the tearing up of the tear ring 6 when our invention is applied, this ring can be made more robust, which was impossible previously owing to the great force which would have been required for tearing open a more robust tear ring.

I claim:

1. A closure device for a thin-walled packing container comprising a cap element, a pull ring attached to said cap element and extending outwardly of said container, and a tubular element provided with a retaining flange, said tubular element being fitted into a pouring opening in the package so that the retaining flange engages with and tightly seals an inwardly turned lip formed in the package wall, a cylindrical tearing ring connecting the periphery of the cap element and the tubular element immediately and vertically above the wall of the tubular element, the outer surface of said cap element being provided with a non-perforated score lined spaced radially inwardly from said cylindrical tearing ring and tubular element and on the side adjacent said pull ring which intersects the direction of pull of the pull ring, the horizontal distance from the interior end of the pull ring to the score line being greater than the distance from the interior surface of the cylindrical tearing ring to the score line, whereby the pull ring, when pulled, tends to hinge about the non-perforated score line and thus exert leverage on said tearing ring to more easily break the tearing ring.

2. A closure device as claimed in claim 1 wherein the non-perforated score line extends transversely of said cap element.

* * * * *